US012344435B2

(12) United States Patent
Elvin-Jensen

(10) Patent No.: US 12,344,435 B2
(45) Date of Patent: Jul. 1, 2025

(54) SLIDING STACKABLE CONTAINER

(71) Applicant: INTERCRATE CONTAINER CORP., West Vancouver (CA)

(72) Inventor: Justin Elvin-Jensen, West Vancouver (CA)

(73) Assignee: INTERCRATE CONTAINER CORP., North Vancouver (CA)

( * ) Notice: Subject to any disclaimer, the term of this patent is extended or adjusted under 35 U.S.C. 154(b) by 0 days.

(21) Appl. No.: 18/141,147

(22) Filed: Apr. 28, 2023

(65) Prior Publication Data

US 2023/0348138 A1 Nov. 2, 2023

Related U.S. Application Data

(60) Provisional application No. 63/336,171, filed on Apr. 28, 2022.

(51) Int. Cl.
*B65D 21/02* (2006.01)
*B65D 1/34* (2006.01)

(52) U.S. Cl.
CPC ..... *B65D 21/0209* (2013.01); *B65D 1/34* (2013.01)

(58) Field of Classification Search
CPC ..... B65D 21/0202; B65D 21/0209; B65D 21/0212–0213; B65D 21/0215; B65D 21/0235; B65D 1/22; B65D 1/34
USPC ..... 206/499, 501, 503–507, 509, 511–512; 220/4.28, 4.31–4.32, 23.2, 23.6
See application file for complete search history.

(56) References Cited

U.S. PATENT DOCUMENTS 2,760,676 A * 8/1956 Knieriem ..... B65D 21/0215 215/10
2,773,624 A * 12/1956 Knieriem ..... B65D 21/0216 220/675
D205,799 S * 9/1966 Josephsen ..... D3/312
3,524,553 A * 8/1970 Zitmore ..... A47B 87/0269 211/126.2
3,549,018 A * 12/1970 Wilson ..... B65D 1/34 206/509
3,750,892 A * 8/1973 Grosse ..... A47B 87/0269 206/509
3,780,905 A * 12/1973 Herolzer ..... B65D 21/046 206/511
3,819,044 A * 6/1974 Bockenstette ..... B65D 21/0234 206/520

(Continued)

*Primary Examiner* — J. Gregory Pickett
*Assistant Examiner* — Brijesh V. Patel
(74) *Attorney, Agent, or Firm* — OYEN, WIGGS, GREEN & MUTALA LLP

(57) ABSTRACT

A container includes a base, four sidewalls, and four corner columns. Each of the sidewalls includes upper and lower edges, an upwardly-extending rail extending proximate to the upper edge, a curved wall extending proximate to the lower edge, and a downwardly-extending foot extending from the curved wall. The foot is horizontally offset from the rail. The four corner columns extend between adjacent ones of the sidewalls. Each of the corner columns includes a first corner wall. Each of the first corner walls includes one or more corner notches proximate to a lower edge of the first corner wall. The container is adapted to slide along at least a portion of another one of the container through slidable engagement of at least one of the corner notches with the rails on the other one of the container.

13 Claims, 16 Drawing Sheets

(56) References Cited

U.S. PATENT DOCUMENTS 4,011,948 A * 3/1977 Rehrig ..... B65D 21/045 206/515
4,023,680 A * 5/1977 Thurman ..... B65D 21/046 206/507
4,093,071 A * 6/1978 Stahl ..... B65D 21/046 206/518
4,106,624 A * 8/1978 Thurman ..... B65D 21/046 206/507
4,183,491 A * 1/1980 Sanders ..... B65D 19/0024 248/346.02
4,197,958 A * 4/1980 Zeni ..... B65D 11/24 220/675
4,347,941 A * 9/1982 Johansson ..... B65D 19/12 217/43 A
4,398,499 A * 8/1983 Blakely ..... A01K 41/065 119/325
4,426,001 A * 1/1984 Stahl ..... B65D 21/046 206/505
4,441,615 A * 4/1984 Goodrich ..... B65D 21/041 206/505
4,549,672 A * 10/1985 Rinkewich ..... B65D 11/16 220/639
4,597,503 A * 7/1986 Lates ..... B65D 1/22 220/675
4,657,148 A * 4/1987 Heng ..... B42F 7/12 D19/92
4,820,383 A * 4/1989 Shchamorov ..... B65D 11/1846 220/6
4,905,833 A * 3/1990 Kreeger ..... B65D 21/062 206/506
5,184,726 A * 2/1993 Box ..... B42F 15/0094 206/509
5,230,601 A * 7/1993 Apps ..... B65D 21/0212 414/788.2
5,344,022 A * 9/1994 Stahl ..... B65D 21/041 206/505
5,439,113 A * 8/1995 Elvin-Jensen ..... B65D 21/0215 206/509
5,575,390 A * 11/1996 Apps ..... B65D 71/70 220/519
5,593,037 A * 1/1997 Ohayon ..... B65D 21/0213 220/675
5,638,973 A * 6/1997 Dewey ..... B65D 11/1873 206/509
D383,906 S * 9/1997 Lev-Ran ..... D9/424
5,816,406 A * 10/1998 Jupille ..... B65D 21/0202 206/521.1
D400,711 S * 11/1998 Hwang ..... D3/307
6,062,388 A * 5/2000 Ohayon ..... B65D 21/0216 206/520
6,273,259 B1 * 8/2001 Stahl ..... B65D 21/046 206/509
6,394,274 B1 * 5/2002 Cheeseman ..... B65D 21/045 206/505
6,749,077 B1 * 6/2004 McAlpine ..... B65D 11/1833 220/4.33
6,752,285 B1 * 6/2004 Scalf ..... B65D 11/1873 220/4.32
D556,263 S * 11/2007 Gusdorf ..... D19/90
D565,664 S * 4/2008 Gusdorf ..... D19/90
7,686,167 B1 * 3/2010 Stahl ..... B65D 21/045 206/509
9,015,992 B1 * 4/2015 Livingston ..... E02B 3/125 47/65.9
9,540,140 B2 * 1/2017 Hassell ..... B65D 21/0215
D816,997 S * 5/2018 Turner ..... D3/304
10,829,268 B2 * 11/2020 Sommer ..... B65D 21/0235
D948,218 S * 4/2022 Turner ..... D3/314
2003/0024844 A1 * 2/2003 Hammett ..... B65D 21/0213 206/505
2003/0183549 A1 * 10/2003 Verna ..... B65D 21/046 206/509
2006/0070906 A1 * 4/2006 Verna ..... B65D 21/041 206/509
2008/0116100 A1 * 5/2008 Hassell ..... B65D 1/34 206/507
2011/0220530 A1 * 9/2011 Weissbrod ..... A45F 5/021 206/503
2012/0211390 A1 * 8/2012 Hassell ..... B65D 85/36 206/557
2012/0241350 A1 * 9/2012 Stahl ..... B65D 21/0215 206/509
2014/0262910 A1 * 9/2014 Sommer ..... B65D 21/0213 206/509
2015/0151875 A1 * 6/2015 Hassell ..... B65D 1/34 206/557

* cited by examiner

SLIDING STACKABLE CONTAINER

CROSS-REFERENCE TO RELATED APPLICATIONS

This application claims the benefit of U.S. Provisional Patent Application No. 63/336,171 filed Apr. 28, 2022, the contents of which are hereby incorporated by reference.

FIELD OF THE INVENTION

The invention relates to containers, and in particular, to containers for storing or transporting food products.

BACKGROUND OF THE INVENTION

Containers used for the storage or transportation of food products typically comprise a base with four sidewalls extending substantially vertically from the base. In many cases, these containers may be stacked on top of each other, in order to reduce the floor space required to store the containers.

However, if the stack of containers becomes too high, the containers are liable to topple over if the containers are not properly arranged. One conventional method for increasing the stability of a stack of containers is to provide protrusions (e.g. on an upper container) and corresponding indents (e.g. on a lower container). This ensures that the containers are somewhat connected to the containers above and below. This method is not always satisfactory though. In particular, it is often necessary to lift a container and place it directly above another container in order to stack them. This is inconvenient, especially where the containers for stacking are already elevated. In addition, it is often difficult to accurately situate containers directly above another container (in order for the protrusions and indents to properly align).

There is therefore a need for a container that is easy and convenient to stack.

SUMMARY OF THE INVENTION

A container in accordance with the present invention comprises a base and four sidewalls extending from the base. Corner columns extend between adjacent ones of the sidewalls. Proximate to an upper edge of the sidewalls, each of the sidewalls comprises an upwardly-extending rail, with a generally horizontal ledge extending outwardly from the rail. Proximate to a lower edge of the sidewalls, each of the sidewalls comprises a curved member that meets with the base. A downwardly-extending foot extends from the curved member. The foot and rail are horizontally offset.

The corner columns are recessed vertically with respect to the sidewalls. That is, the corner columns are generally shorter than the sidewalls. One or more corner notches are located on a lower edge of each of the corner columns.

When the containers are to be stacked, the corner notches of the upper container may be used to initially engage with the rails on the lower container. By angling the top container downward, at least a portion of the feet on the top container can then engage with the rails on the lower container. The upper container can then be slid across the lower container (through the engagement of the feet of the upper container with the rails of the lower container). Once the feet of the upper container reaches the end of the rails of the lower container, the corner columns of the upper container will slide into and engage with the corner columns of the lower container, thus fixing the upper container in place above the lower container.

In one embodiment, a container comprises a base, four sidewalls, and four corner columns. The base comprises four base edges extending along at least a portion of a perimeter of the base. One of the sidewalls extends from each of the four base edges. Each of the sidewalls comprises upper and lower edges, an upwardly-extending rail extending proximate to the upper edge, a curved wall extending proximate to the lower edge, and a downwardly-extending foot extending from the curved wall. The foot is horizontally offset from the rail. The four corner columns extend between adjacent ones of the sidewalls. Each of the corner columns comprises a first corner wall. Each of the first corner walls comprises one or more corner notches proximate to a lower edge of the first corner wall. The container is adapted to slide along at least a portion of another one of the container through slidable engagement of at least one of the corner notches with the rails on the other one of the container.

In another embodiment, the container is further adapted to stack on top of the other one of the container by engagement of the feet with the rails on the other one of the container.

In yet another embodiment, the container is adapted to slide along the other one of the container through slidable engagement of two of the corner notches with the rails on the other one of the container.

In still yet another embodiment, the foot is inward of the rail.

In still a further embodiment, each of the outer corner walls comprises at least two corner notches.

In another embodiment, each of the corner columns further comprises a second corner wall. The first and second corner walls define, at least in part, a corner channel extending for at least a portion of a height of the corner column.

In still another embodiment, the corner columns are shorter than the sidewalls.

The foregoing was intended as a summary only and of only some of the aspects of the invention. It was not intended to define the limits or requirements of the invention. Other aspects of the invention will be appreciated by reference to the detailed description of the embodiments.

BRIEF DESCRIPTION OF THE DRAWINGS

The preferred embodiment of the invention will be described by reference to the drawings thereof, in which.

DETAILED DESCRIPTION OF THE INVENTION

Figure 1:
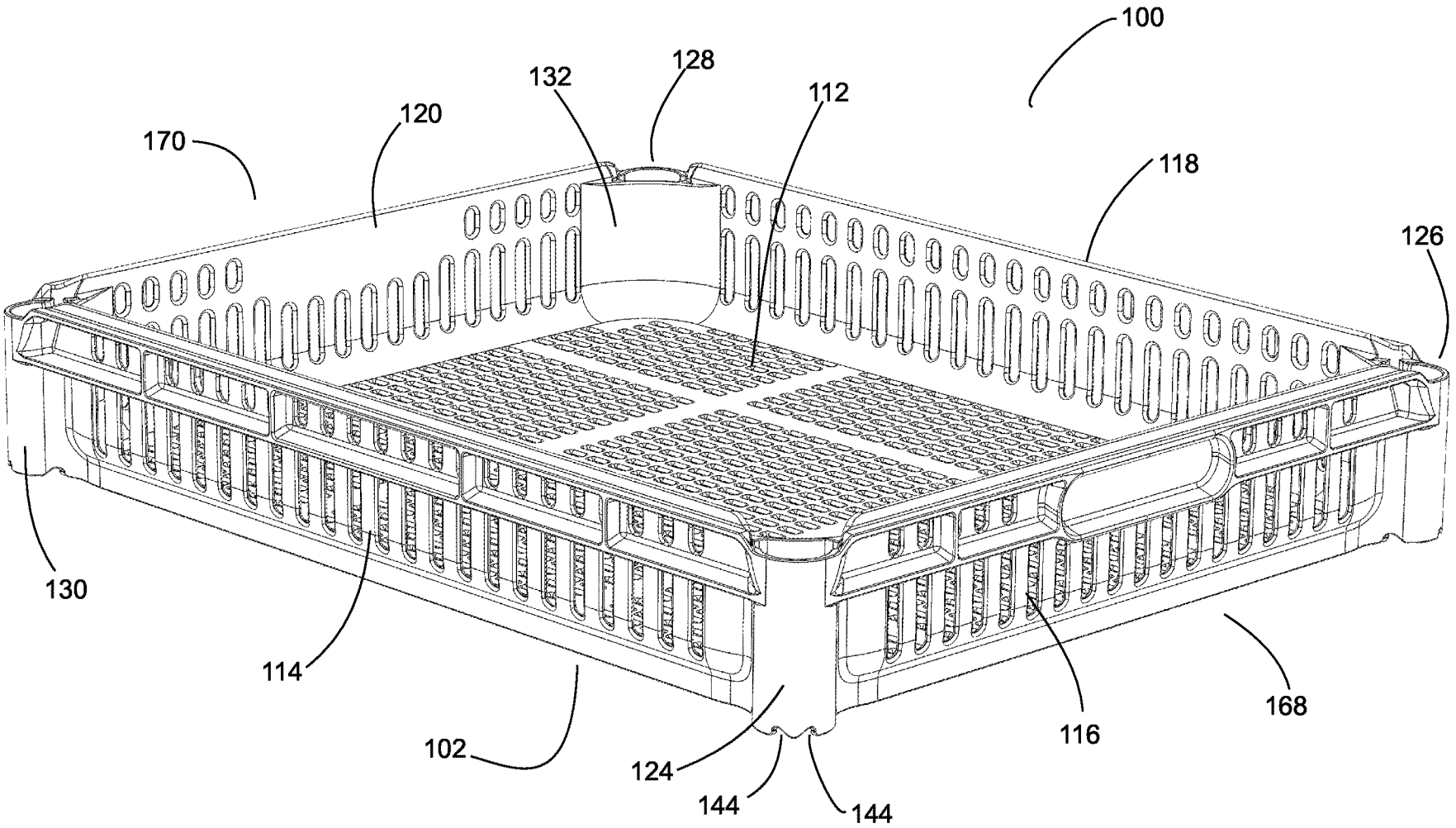
FIG. 1 is a top perspective view of a container in accordance with the present invention.

Referring to FIGS. 1 to 6, a container 100 in accordance with an embodiment of the present invention comprises a base 102 with first, second, third, and fourth base edges 104, 106, 108, and 110 extending along a perimeter of the base 102. Preferably, the first and third base edges 104, 108 are substantially parallel to each other, while the second and fourth base edges 106, 110 are substantially parallel to each other. Preferably, the base 102 has a substantially rectangular shape. The base 102 comprises an inner base surface 112.

The container 100 comprises first and second ends 168, 170, with the first and third base edges 104, 108 extending between the first and second ends 168, 170. The second and fourth base edges 106, 110 extend along the first and second ends 168, 170, respectively.

First, second, third, and fourth sidewalls 114, 116, 118, 120 extend from the base 102 from the first, second, third, and fourth base edges 104, 106, 108, 110, respectively. Preferably, the first, second, third, and fourth sidewalls 114, 116, 118, 120 extend substantially perpendicularly from the first, second, third, and fourth base edges 104, 106, 108, 110, respectively, such that the container 100 has a substantially cuboid shape. Each of the first, second, third, and fourth sidewalls 114, 116, 118, 120 comprise an inner sidewall surface 122.

First, second, third, and fourth corner columns 124, 126, 128, 130 extend between adjacent ones of the sidewalls 114, 116, 118, 120. In particular, the first corner column 124 extends between the first and second sidewalls 114, 116; the second corner column 126 extends between the second and third sidewalls 116, 118; the third corner column 128 extends between the third and fourth sidewalls 118, 120; and the fourth corner column 130 extends between the fourth and first sidewalls 120, 114.

Figure 2:
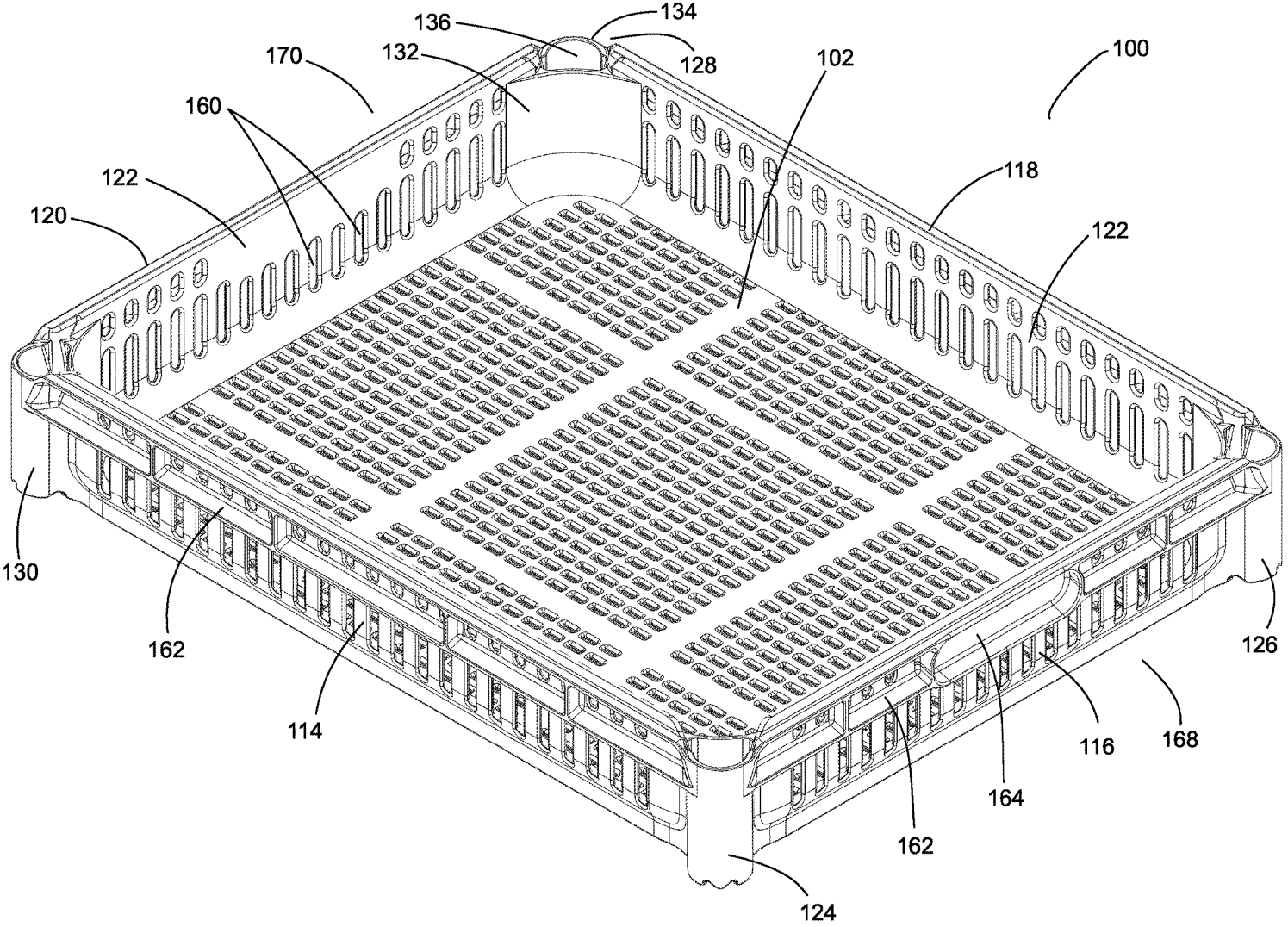
FIG. 2 is another top perspective view of the container of FIG. 1.
Figure 4:
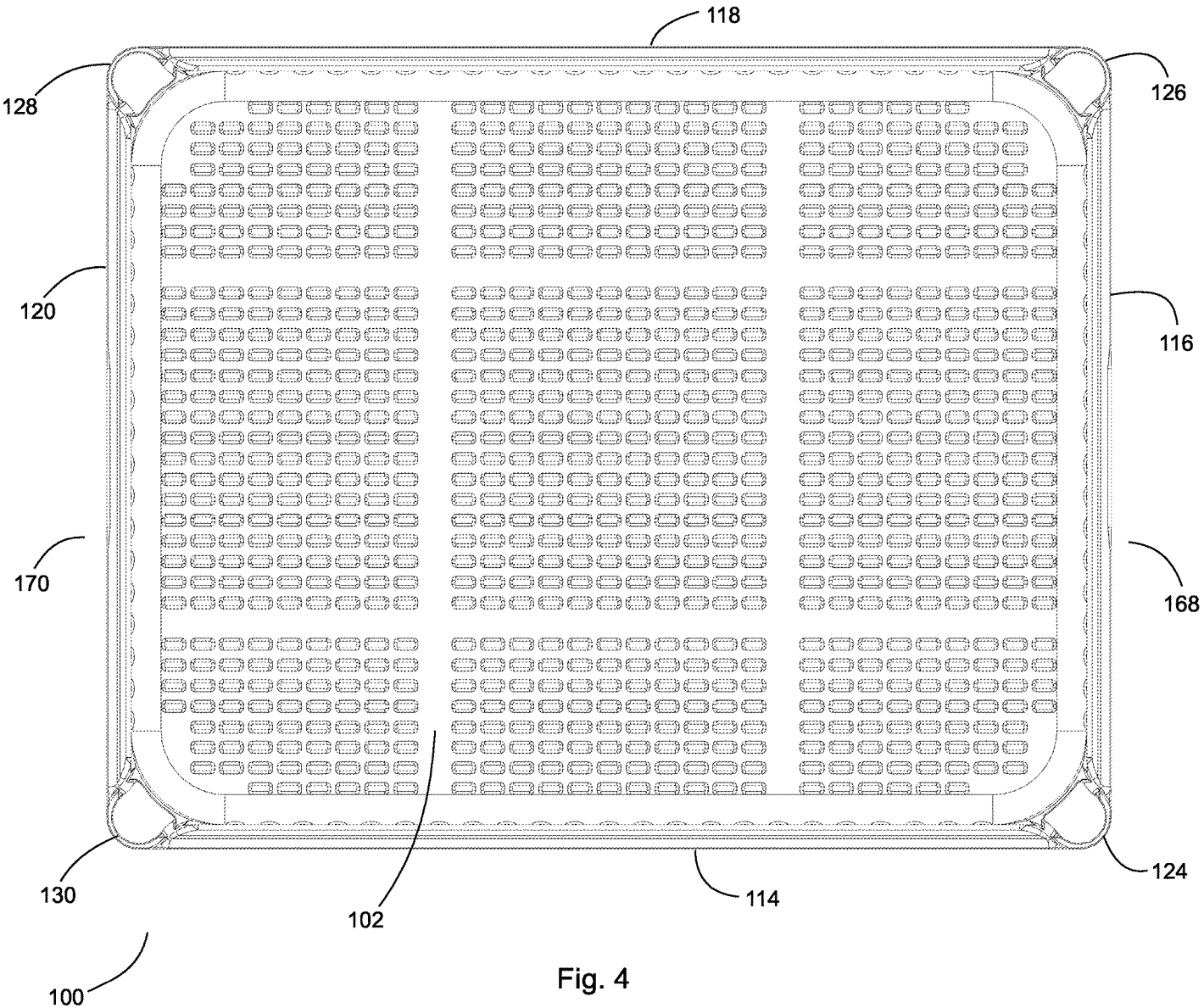
FIG. 4 is a top view of the container of FIG. 1.
Figure 5:
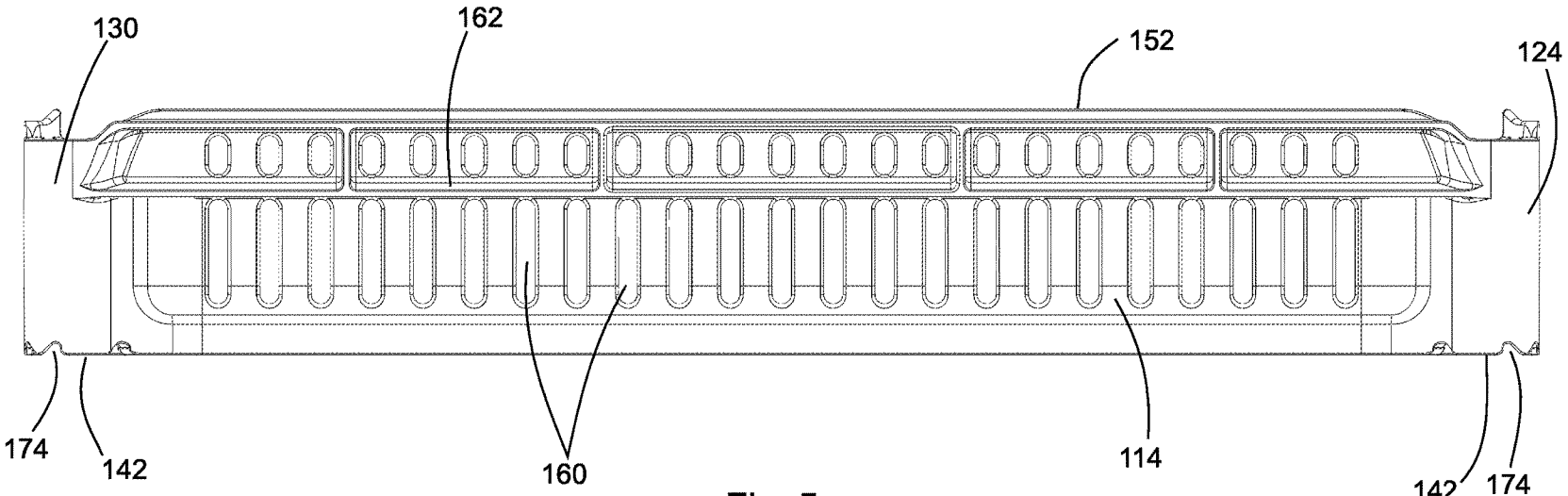
FIG. 5 is a front view of the container of FIG. 1.
Figure 6:
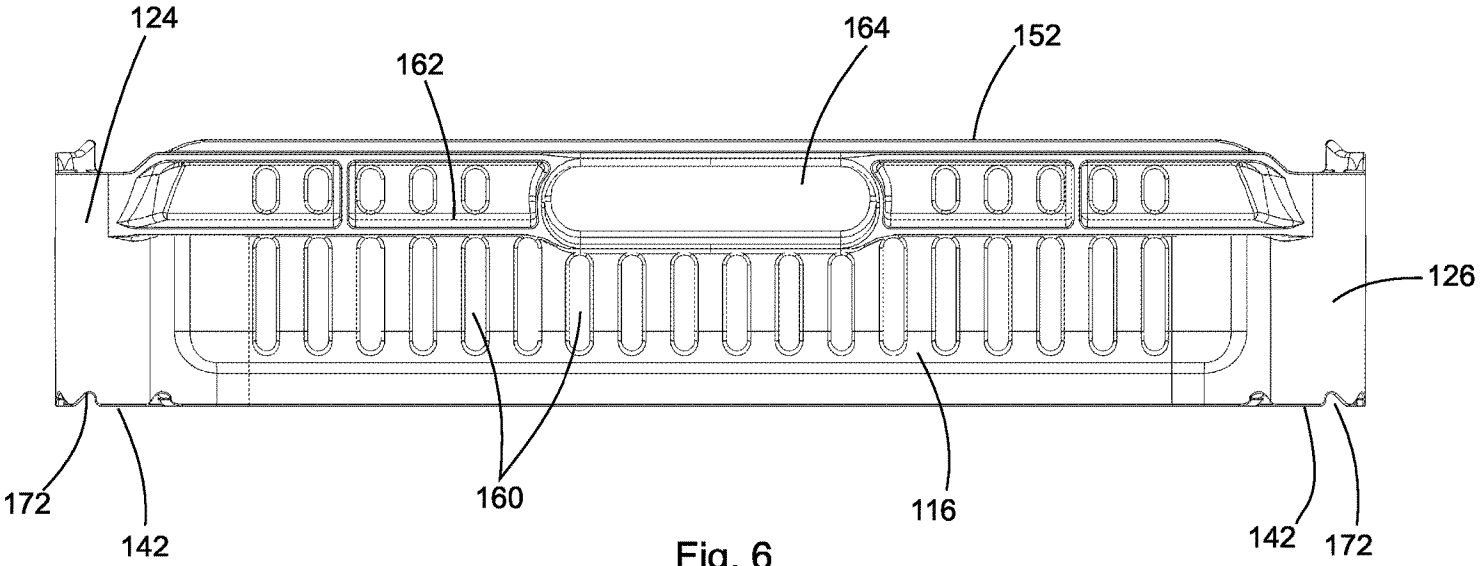
FIG. 6 is a side view of the container of FIG. 1.

The corner columns 124, 126, 128, 130 are generally rounded such that the container 100, when viewed from above, as in FIG. 4, has generally rounded corners. Referring to FIG. 2, each of the corner columns 124, 126, 128, 130 comprises an inner corner wall 132 and an outer corner wall 134. The inner and outer corner walls 132, 134 define, at least in part, a corner channel 136 that extends for at least a portion of a height of the container 100. The inner corner wall 132 comprises an inner corner edge 138. The inner corner wall 128 is preferably generally curved to form a generally smooth and continuous surface between the inner sidewall surfaces 122 of adjacent ones of the sidewalls 114, 116, 118, 120. For example, FIG. 7, which depicts a partial view of the container 100 about the third corner column 128, the inner corner wall 132 provides for a generally smooth and continuous transition between the inner sidewall surfaces 122 of the first and second sidewalls 114, 116. The first, second, and fourth corner columns 124, 126, 130 provide for a similar configuration.

The outer corner wall 134 is also preferably curved, but its degree of curvature may be greater than that of the inner corner wall 128, as shown in FIG. 4. The outer corner wall 134 comprises upper and lower corner edges 140, 142. Preferably, the upper corner edge 140 is substantially straight (e.g. substantially horizontal) and substantially level with the inner corner edge 138. The lower corner edge 142 preferably comprises one or more corner notches 144, which will be described in further detail later.

Figure 7:
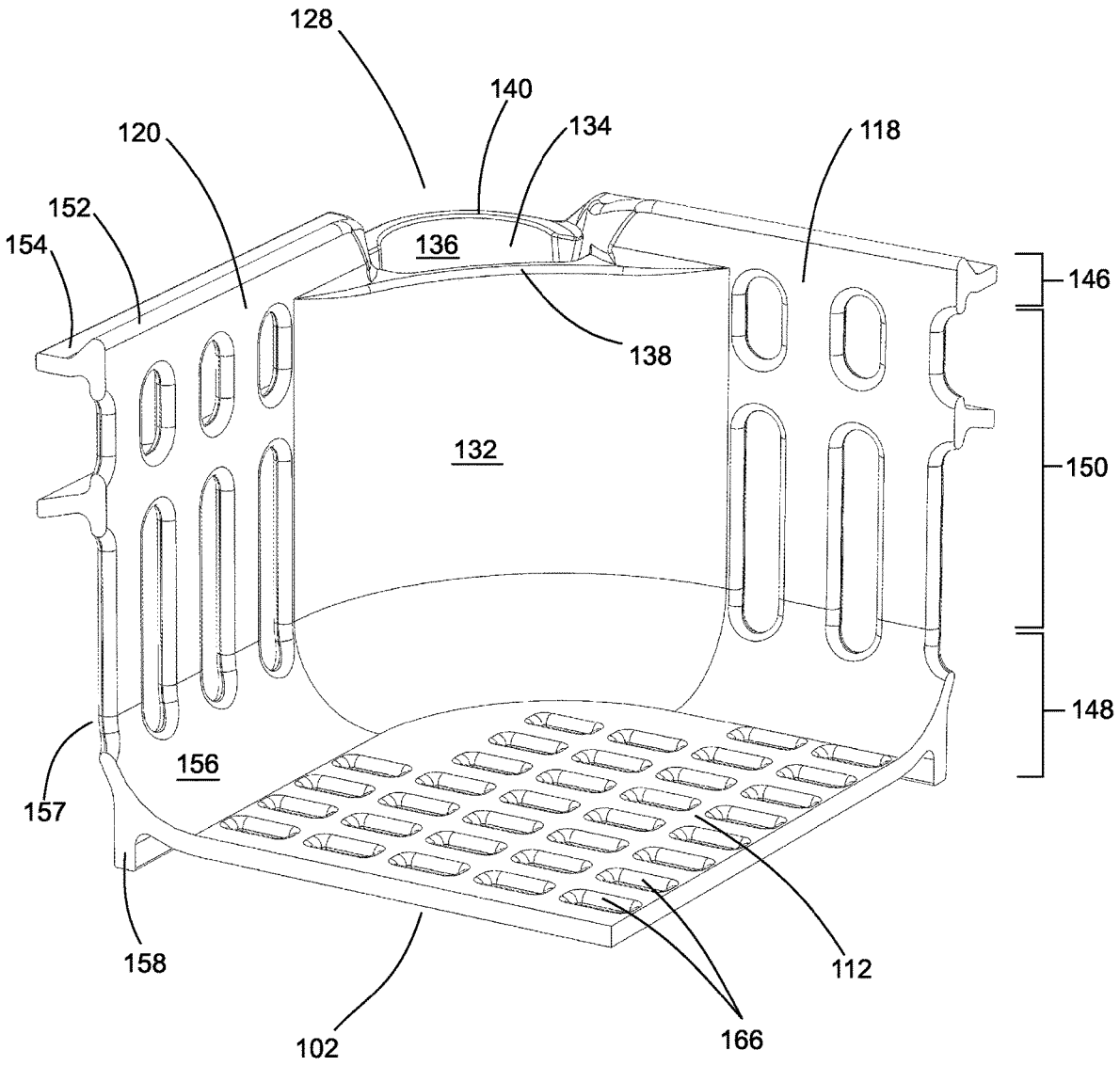
FIG. 7 is a partial view of the container of FIG. 1.

Referring to FIG. 7, each of the sidewalls 114, 116, 118, 120 comprises an upper portion 146, a lower portion 148, and a wall portion 150 between the upper portion 146 and the lower portion 148. The upper portion 146 comprises an upwardly-extending rail 152 and a ledge 154 extending from the rail 152. Preferably, the ledge 154 extends substantially horizontally from the rail 152.

The lower portion 148 comprises a curved wall 156 that extends between the wall portion 150 and the base 102. The curved wall 156 comprises a curved wall edge 157 that meets with the wall portion 150. The curved wall 156 provides for a generally smooth and continuous transition from the inner sidewall surfaces 122 to the inner base surface 112. A downwardly-extending foot 158 extends from the curved wall 156. Preferably, the foot 158 extends generally vertically from the curved wall 156. Referring to FIG. 7, the foot 154 preferably extends from the curved wall 156 at a distance from the curved wall edge 157. As such, the foot 158 is horizontally offset from the rail 152 (i.e. the foot 154 and the rail 152 are not coplanar, with the foot 154 inward of the rail 152).

As best shown in FIGS. 1 and 7, the corner columns 124, 126, 128, 130 are preferably shorter than the sidewalls 114, 116, 118, 120. In other words, the upper corner edges 140 and/or the inner corner edges 138 of the corner columns 124, 126, 128, 130 preferably sit below the rails 152 of the sidewalls 114, 116, 118, 120 and are generally recessed in comparison with the sidewalls 114, 116, 118, 120. Preferably, the inner corner edges 138 and the upper corner edges 140 are level with each other, but recessed with respect to the rails 152.

The wall portion 150 preferably comprises a plurality of wall openings 160 extending therethrough. The wall openings 160 may provide ventilation for the container 100. In addition, the wall portion 150 may comprise one or more outwardly extending ribs 162. The ribs 162 may act to provide additional strength and rigidity to the sidewalls 114, 116, 118, 120. The wall portion 150 may also comprise handhold openings 164 to allow for the insertion of fingers to facilitate the grasping of the container 100.

Figure 3:
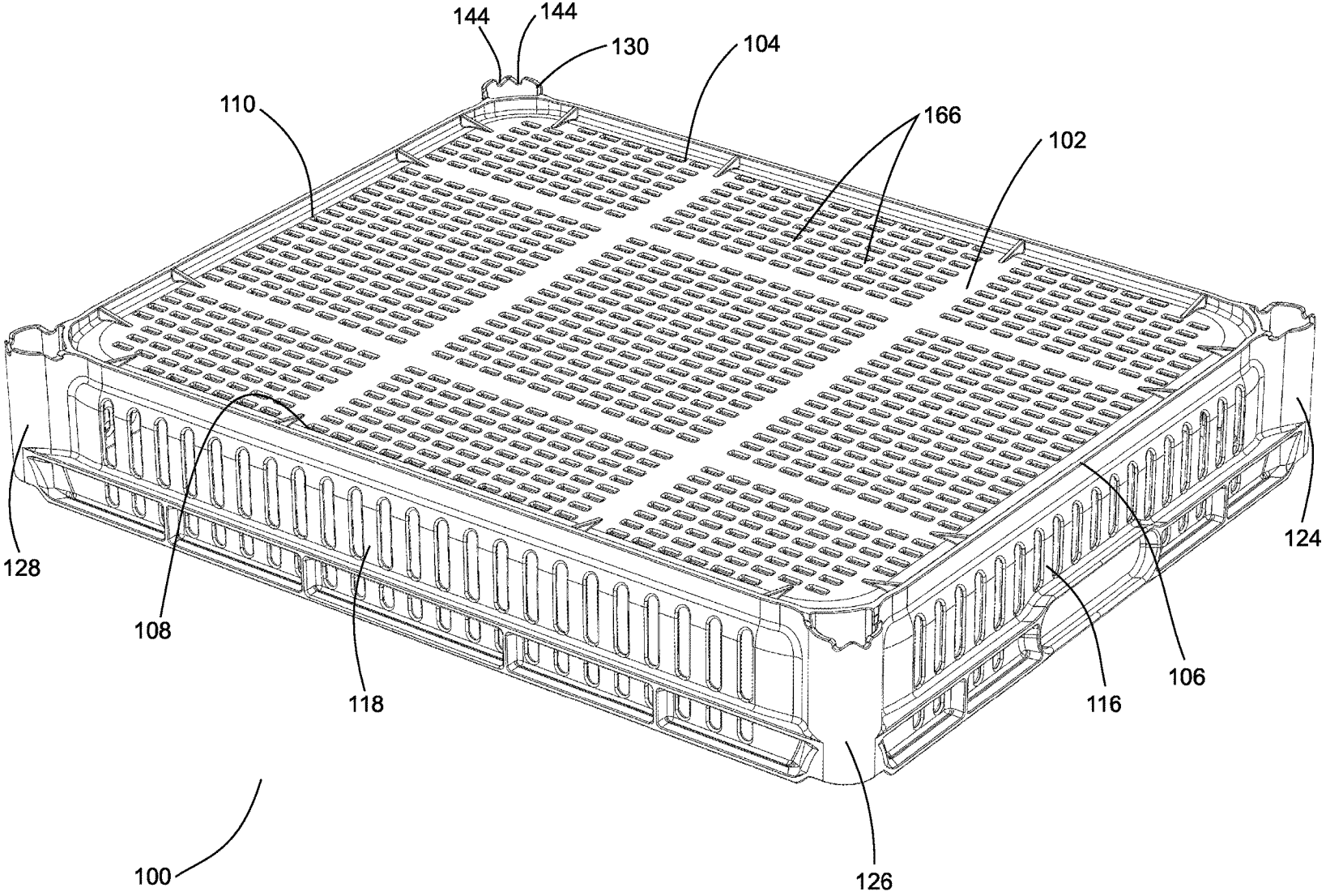
FIG. 3 is a bottom perspective view of the container of FIG. 1.

Referring to FIG. 3, the base 102 preferably comprises a plurality of base openings 166 extending therethrough.

Figure 8:
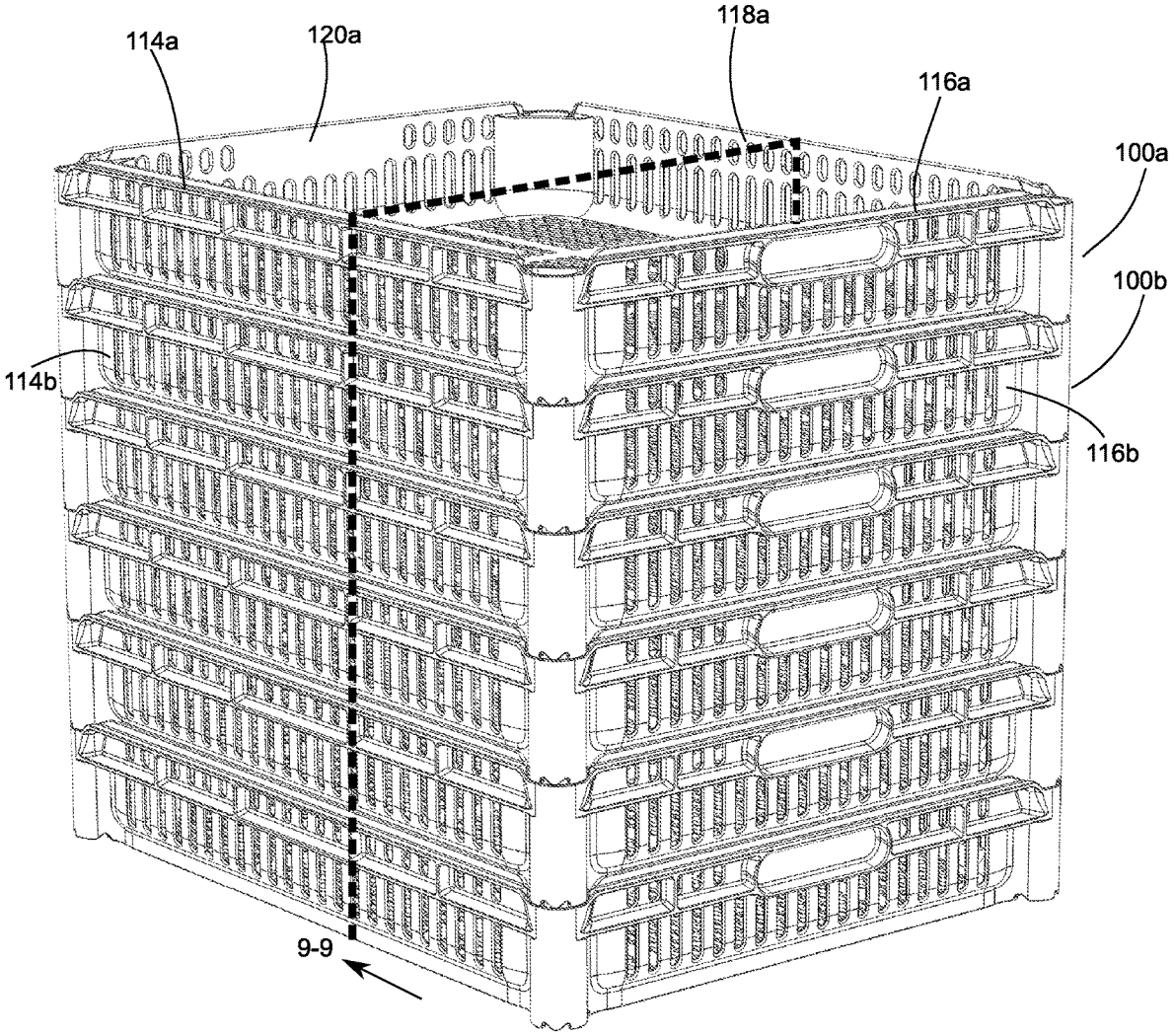
FIG. 8 shows a number of containers in accordance with the present invention stacked on each other.
Figure 9:
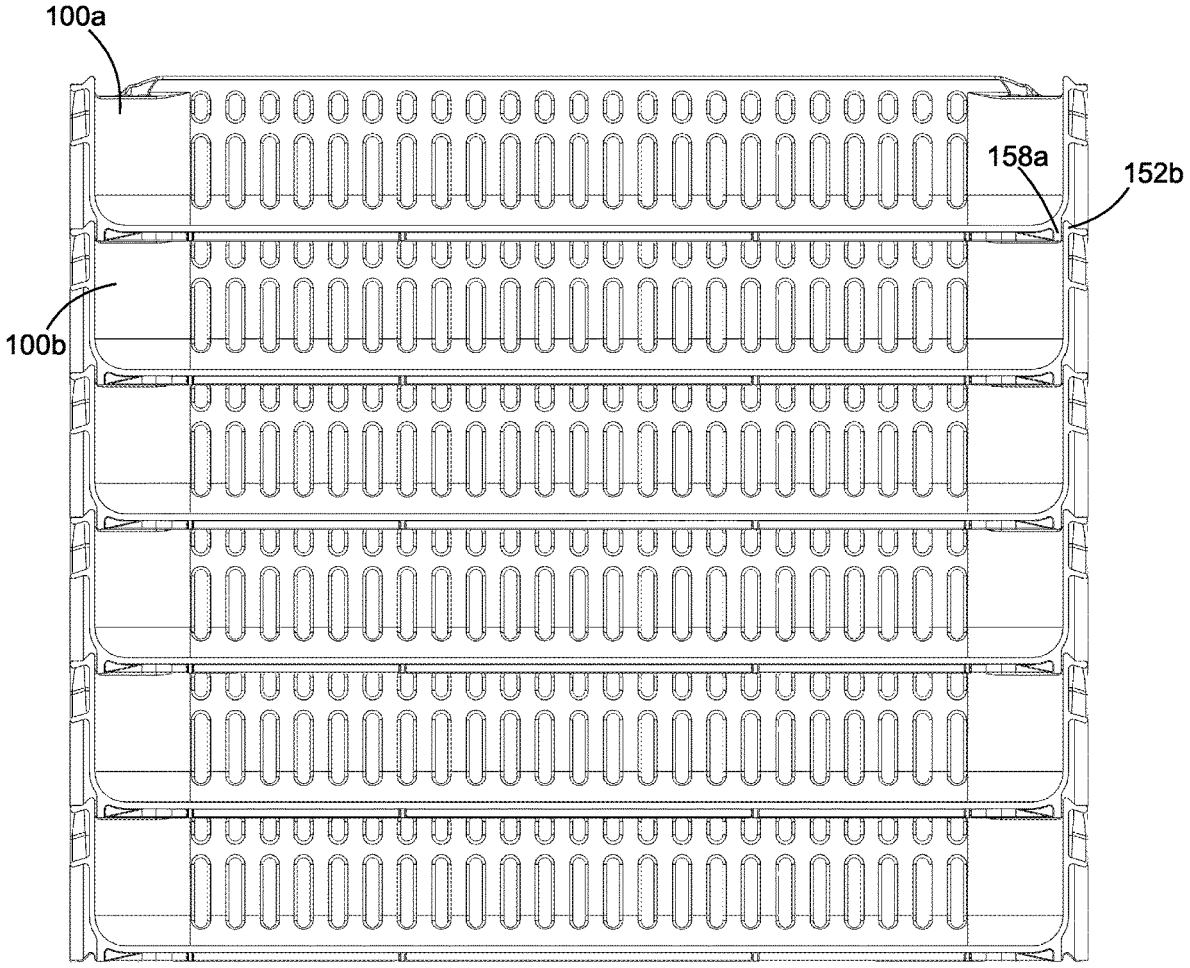
FIG. 9 is a cross-sectional view of the containers of FIG. 8 taken along plane 9-9 of FIG. 8.

The stacking mechanism of the container 100 will now be described. FIG. 8 depict a number of the containers 100, including a first container **100*a* and a second container 100*b*. In order to stack the first container 100*a* on the second container 100*b*, the first container 100*a* is first held above the second container 100*b*. The feet 158*a* on the sidewalls 114*a*, 116*a*, 118*a*, 120*a* of the first container 100*a* are placed above the rails 152*b* on the sidewalls 114*b*, 116*b*, 118*b*, 120*b* of the second container 100*b*. The geometry of the feet 158*a* and the rails 152*b* are such that when the first container 100*a* is placed within (i.e. stacked on) the second container 100*b*, the feet 158*a* fit snugly within the rails 152*b*. In particular, the feet 158*a* of the first and third sidewalls 114*a*, 118*a* fit between the rails 152*b* of the first and third sidewalls 114*b*, 118*b*. Similarly, the feet 158*a* of the second and fourth sidewalls 116*a*, 120*a* fit between the rails 152*b* of the second and fourth sidewalls 116*b*, 120*b*. As described above, the feet 158 are inward of the rails 152. This is best shown in FIG. 9, which is a cross-sectional view of FIG. 8 taken along plane 9-9 of FIG. 8. FIG. 9 shows the arrangement of the feet 158*a* with respect to the rails 152*b***.

Furthermore, the curved walls **152*a* on the sidewalls 114*a*, 116*a*, 118*a*, 120*a* will engage with the rails 148*b* on the sidewalls 114***b*, 116*b*, 118*b*, 120*b*, thereby preventing the first container 100*a* from being pushed too far within the second container 100*b*.

Referring to FIGS. 8 and 9, as described above, the inner corner edges 138 and/or the upper corner edges 140 of the corner columns 124*b*, 126*b*, 128*b*, 130*b* of the second container 100*b* are preferably lower or recessed with respect to the sidewalls 114*b*, 116*b*, 118*b*, 120*b*. This allows the corner columns 124*a*, 126*a*, 128*a*, 130*a* of the first container 100*a* to sit substantially flush on the corner columns 124*b*, 126*b*, 128*b*, 130*b* of the second container 100*b* when the first container 100*a* is placed within the second container 100*b*. For example, the lower corner edges 142*a* of the first container 100*a* engages with the upper corner edge 140*b* of the second container 100*b* when the first container 100*a* is placed within the second container 100*b*.

When the first container 100*a* is engaged within the second container 100*b* as described above, the engagement of the feet 158*a* of the first container 100*a* with the rails 152*b* of the second container 100*b* prevent any lateral movement of the first container 100*a* with respect to the second container 100*b*.

The first container 100*a* may be removed from the second container 100*b* by lifting the first container 100*a* upwardly until the feet 158*a* of the first container 100*a* are no longer engaged with the rails 152*b* of the second container 100*b*.

Figure 10:
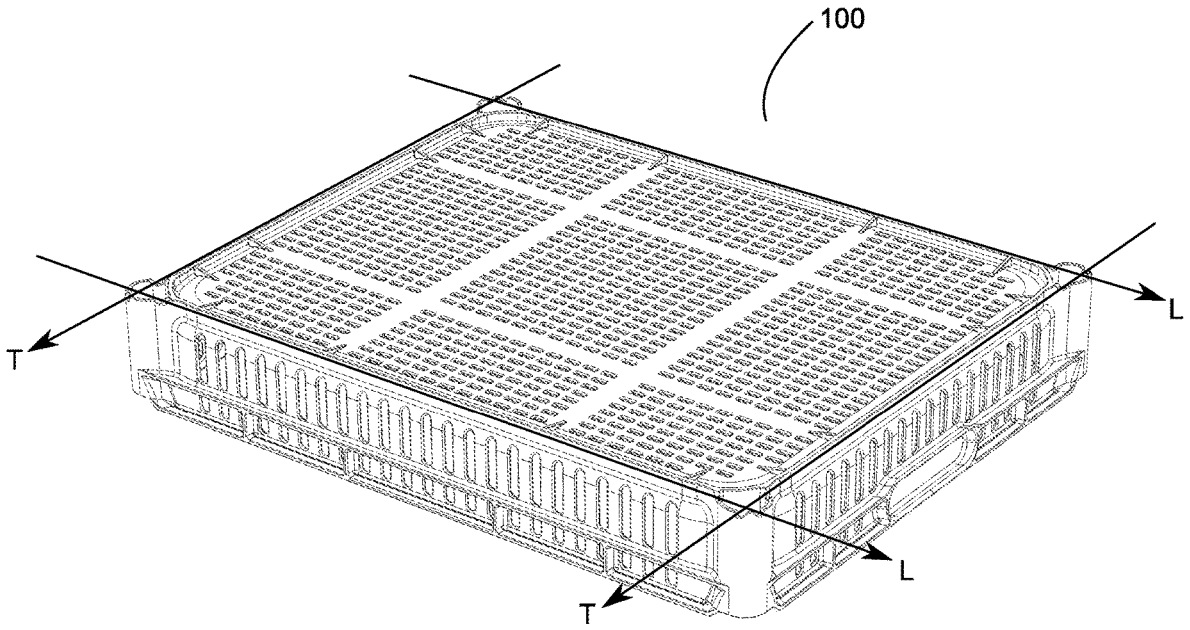
FIG. 10 is a bottom perspective view of one of the containers of FIG. 8.
Figure 11:
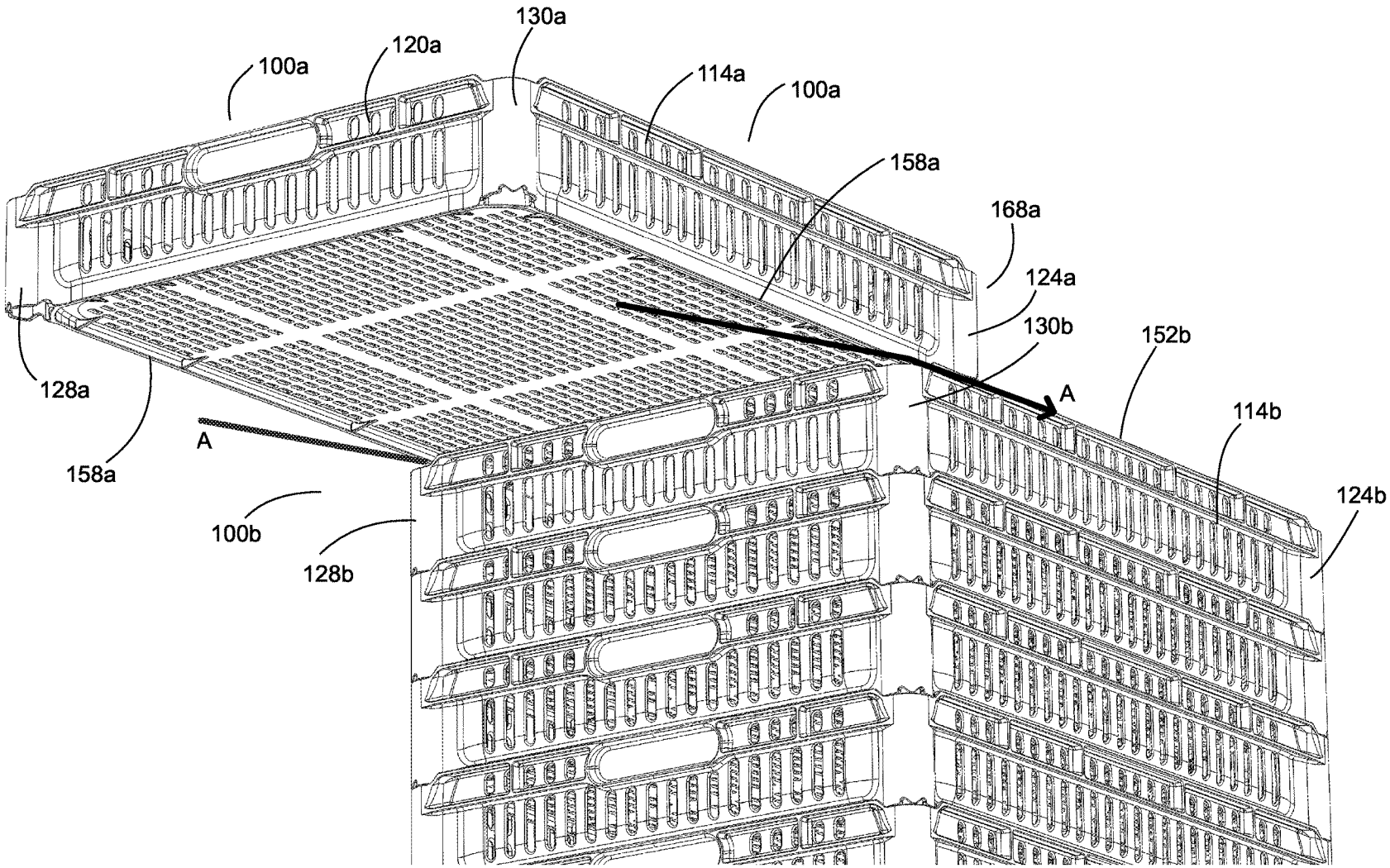
FIGS. 11 to 15 show various stages in the sliding of the containers in accordance with the present invention.
Figure 12:
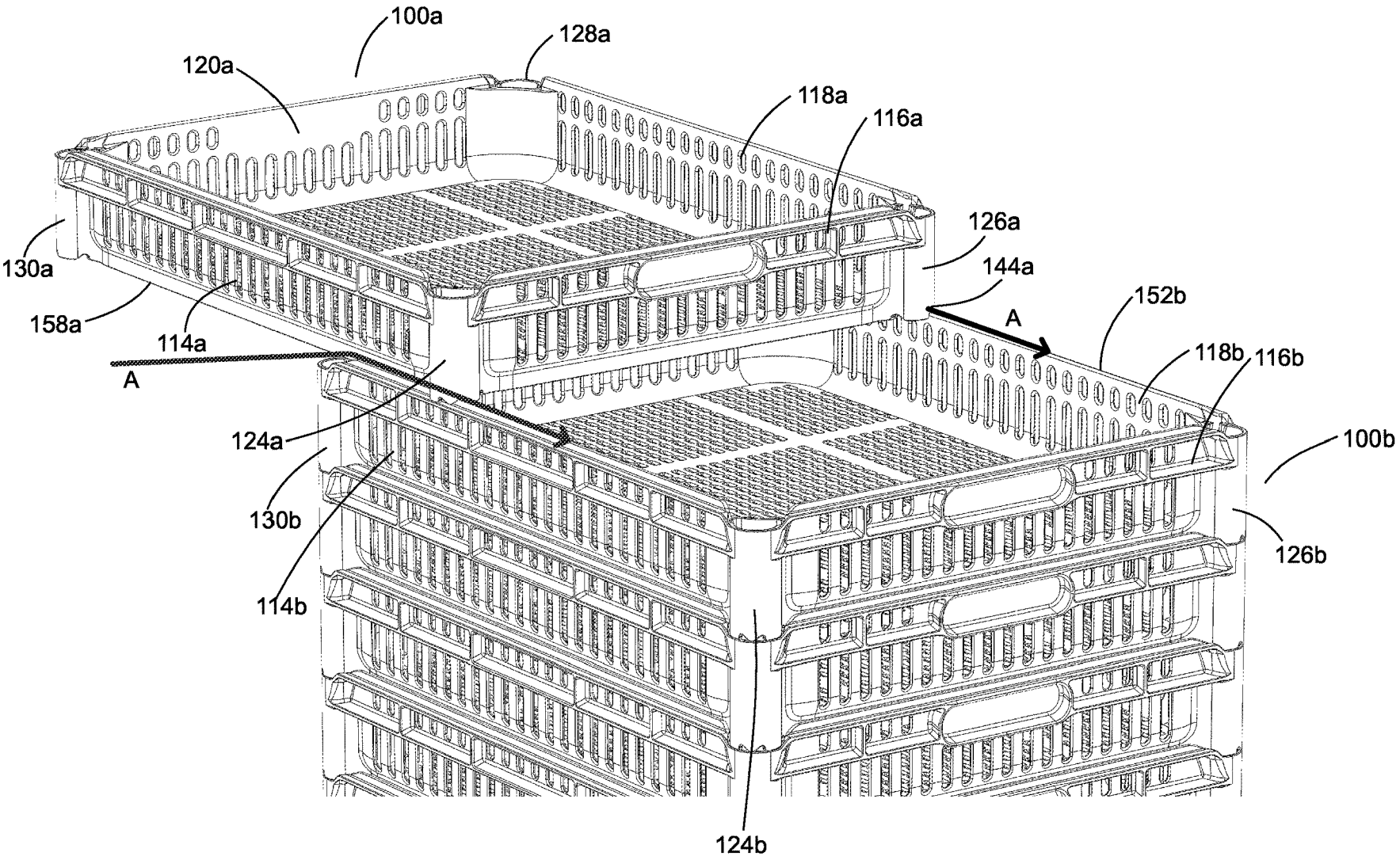

The container 100 can be slid along both a longitudinal axis L and a transverse axis T, which are shown in FIG. 10. Referring to FIGS. 11 to 15, the sliding mechanism of the container 100 will now be described. FIGS. 11 to 15 depicts the first container 100*a* sliding along the second container 100*b* in a direct A, which corresponds to the longitudinal axis L of the containers 100*a*, 100*b*; it is understood that it is also possible to slide the containers 100*a*, 100*b* along the transverse axis T.

Figure 13:
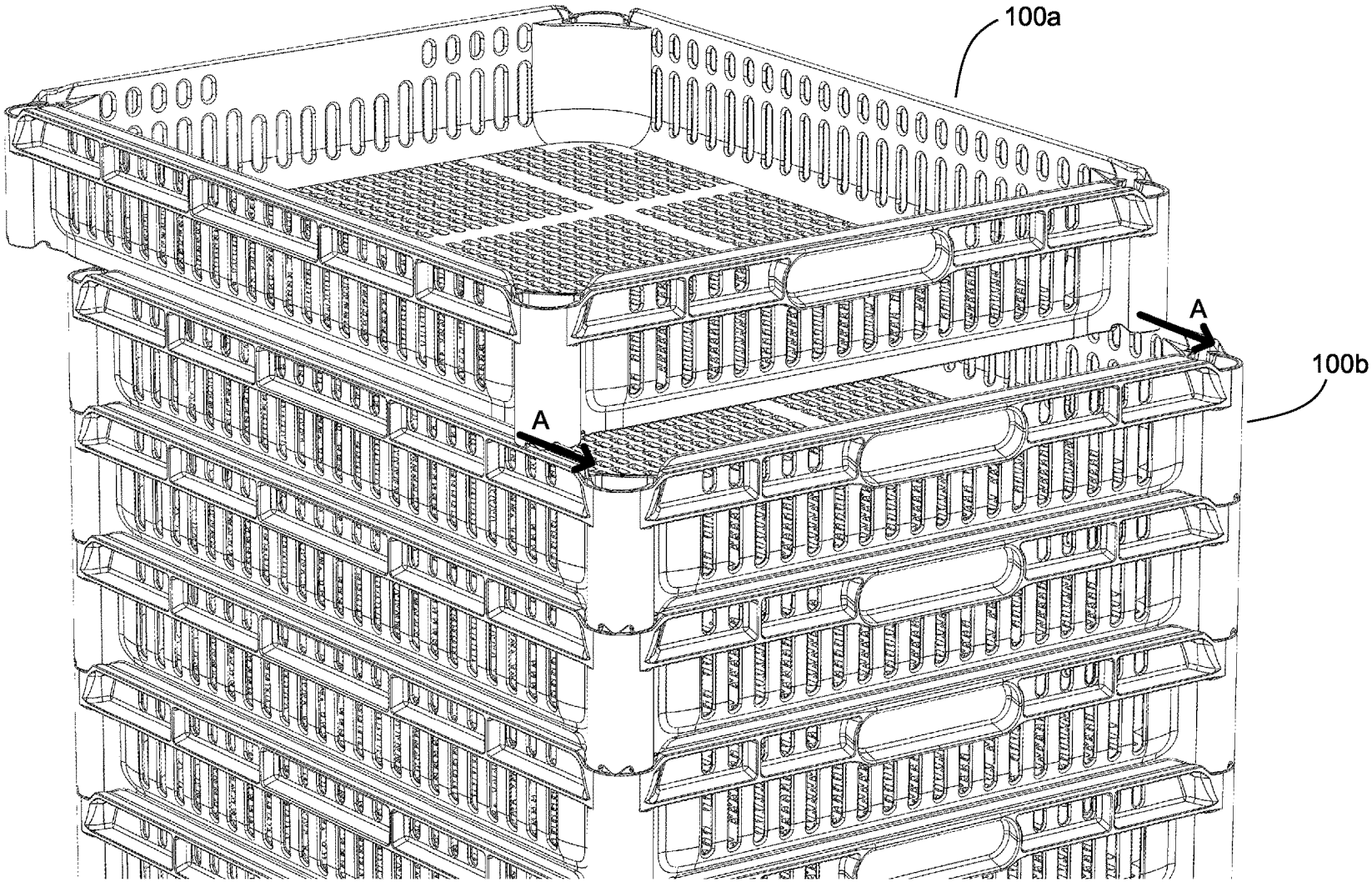
Figure 14:
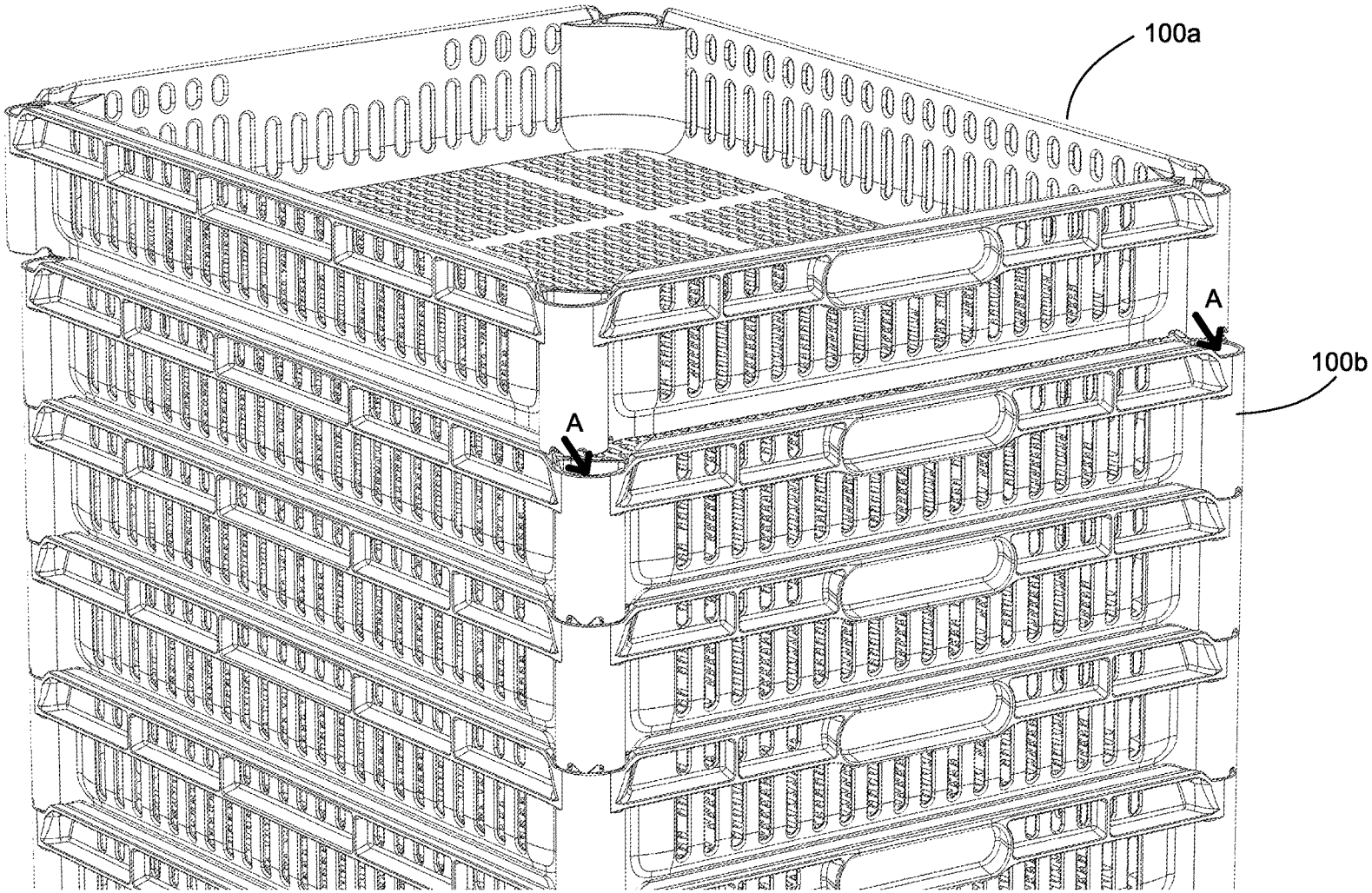
Figure 15:
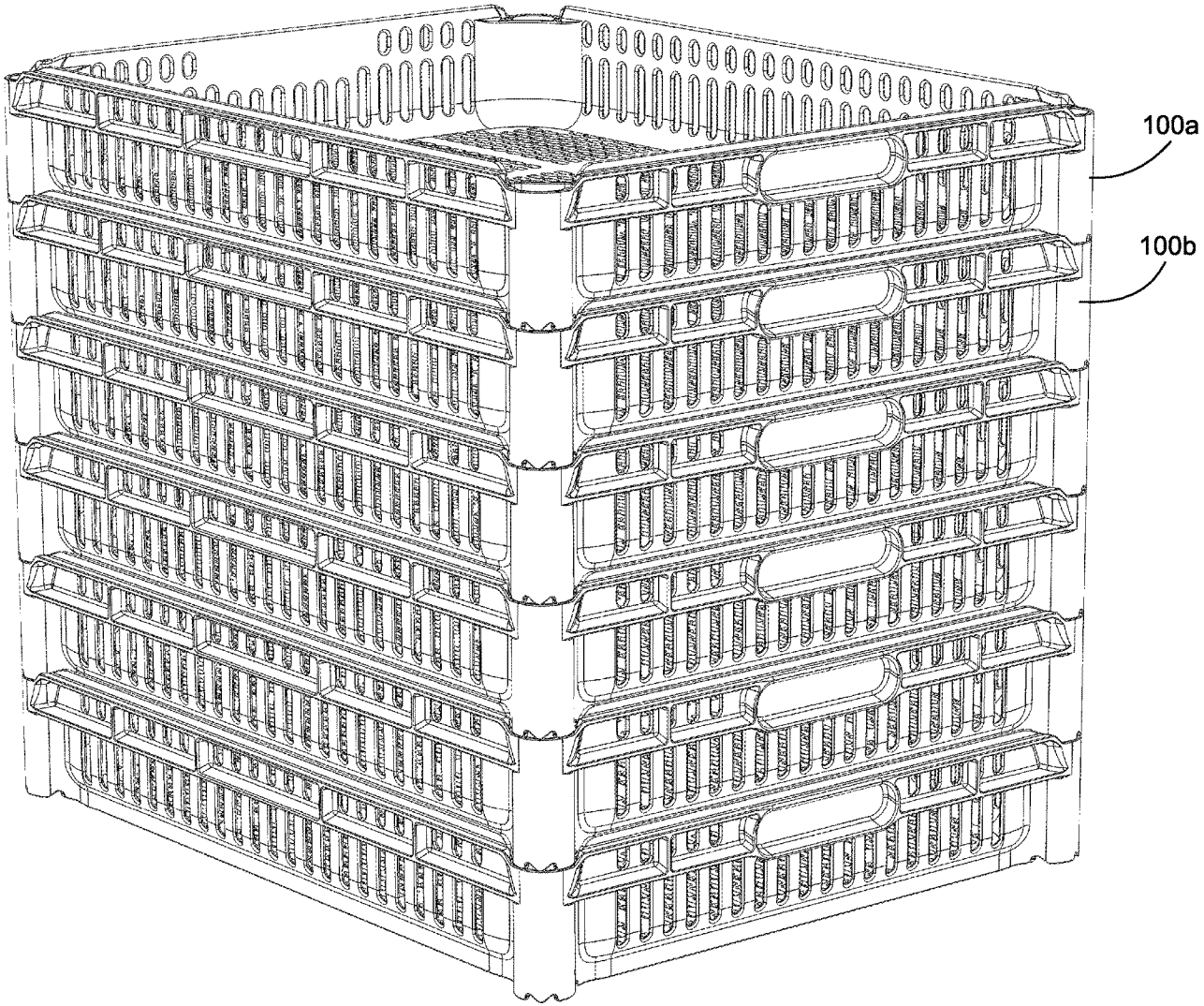

FIGS. 11 to 15 shows the sliding mechanism of the container 100 from beginning (FIG. 11) to end (FIG. 15). In order to initiate sliding of the first container 100*a* along the second container 100*b* in direction A, the first end 168*a* of the first container 100*a* is angled slightly downwardly and placed on the second container 100*b* such that the first end 168*a* of the first container 100*a* comes into contact with the rails 152*b* of the first and third sidewalls 114*b*, 118*b* of the second container 100*b* (shown in FIG. 12). One of the corner notches 144*a* on each of the first and second corner columns 124*a*, 126*a* is adapted to slidably engage with the rails 152*b* on the first and third sidewalls 114*b*, 118*b*, respectively, on the second container 100*b*. Preferably, the angle of the first container 100*a* can then be flattened until at least a portion of the feet 158*a* on the first and third sidewalls 114*a*, 118*a* on the first container 100*a* engages with the rails 152*b* on the first and third sidewalls 114*b*, 118*b*, respectively, on the second container 100*b*. The first container 100*a* can then be slid along the second container 100*b* in direction A, as shown in FIG. 13, (such that the first end 168*a* of the first container 100*a* is slid toward the first end 168*b* of the second container 100*b*) until one of the corner notches 144*a* on the first and second corner columns 124*a*, 126*a* of the first container 100*a* approach the ends of the rails 152*b* on the first and third sidewalls 114*b*, 118*b* on the second container 100*b*.

As shown in FIG. 14, the first and second corner columns 124*a*, 126*a* of the first container 100*a* will be able to slide into and engage with the first and second corner columns 124*b*, 126*b* of the second container 100*b*, respectively (due to the recessed nature of the first and second corner columns 124*b*, 126*b*). The third and fourth corner columns 128*a*, 130*a* of the first container 100*a* will also slide into and engage with the corner columns 128*b*, 130*b* of the second container 100*b*, respectively. Once the corner columns 124*a*, 126*a*, 128*a*, 130*a* of the first container 100*a* have engaged with the corresponding four corner columns 124*b*, 126*b*, 128*b*, 130*b* of the second container 100*b*, the first container 100*a* will be securely held in place within the second container 100*b* (as shown in FIG. 15).

The first and second containers 100*a*, 100*b* can be slid along the transverse axis T in a similar manner, with other ones of the corner notches 144*a* on the first container 100*a* engaging the rails 152*b* of the second and fourth sidewalls 116*b*, 120*b* of the second container 100*b*.

Because the containers 100*a*, 100*b* can be slid along both their longitudinal and transverse axes L, T, there are preferably two of the corner notches 144 on each of the corner columns 124, 126, 128, 130. For example, in the embodiment shown in FIGS. 1 to 7, the corner notches 144 comprise first and second corner notches 172, 174. When the container 100 is slid along the longitudinal axis L, the first corner notches 172 will engage the rails 152 of the container 100 below. When the container 100 is slid along the transverse axis T, the second corner notches 174 will engage the rails 152 of the container 100 below.

The presence of the corner notches 144 assist in allowing for the sliding action of one of the containers 100 along another one of the containers 100 below it. In addition, the recessed nature of the corner columns 124, 126, 128, 130 (with respect to the sidewalls 114, 116, 118, 120) allow for easier locating (and stacking) of one of the containers 100 on top of another one of the containers 100 below it.

Figure 16:
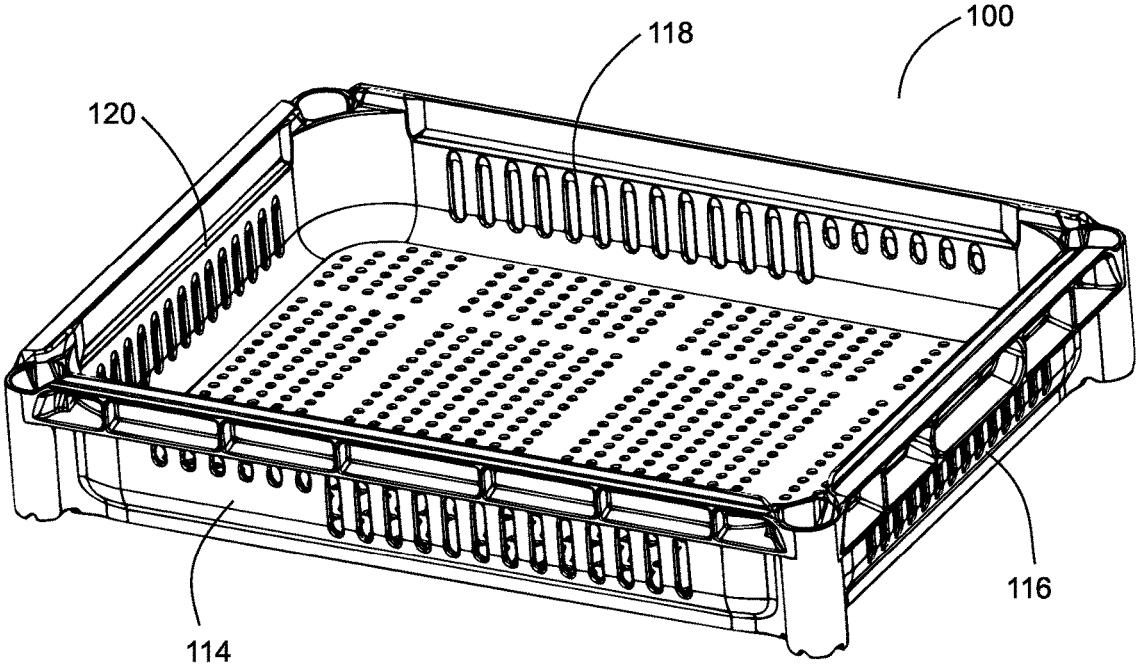
FIGS. 16 and 17 show other embodiments of the container.
Figure 17:
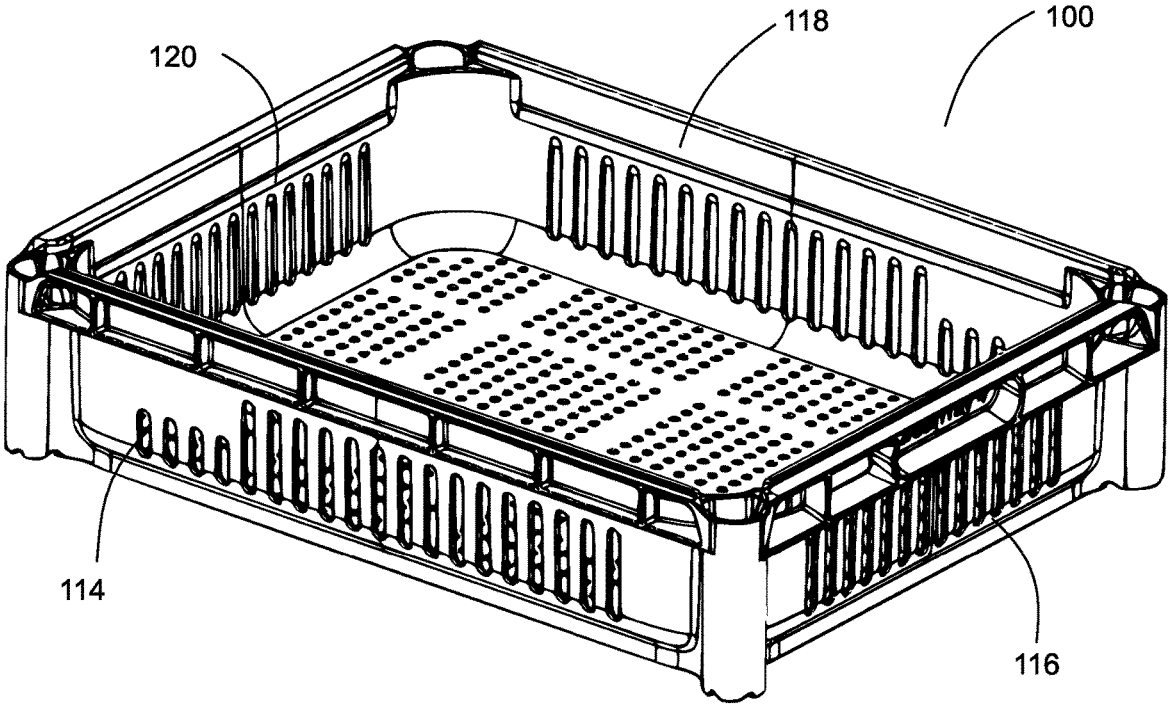

FIGS. 1 to 7 depict one embodiment of the container 100. However, it is understood that the container 100 may be of different heights without affecting the principles of the invention. For example, FIGS. 16 and 17 depict other embodiments of the container 100 in which the sidewalls 114, 116, 118, 120 are of a proportionally different height than the embodiment shown in FIGS. 1 to 7.

Figure 18:
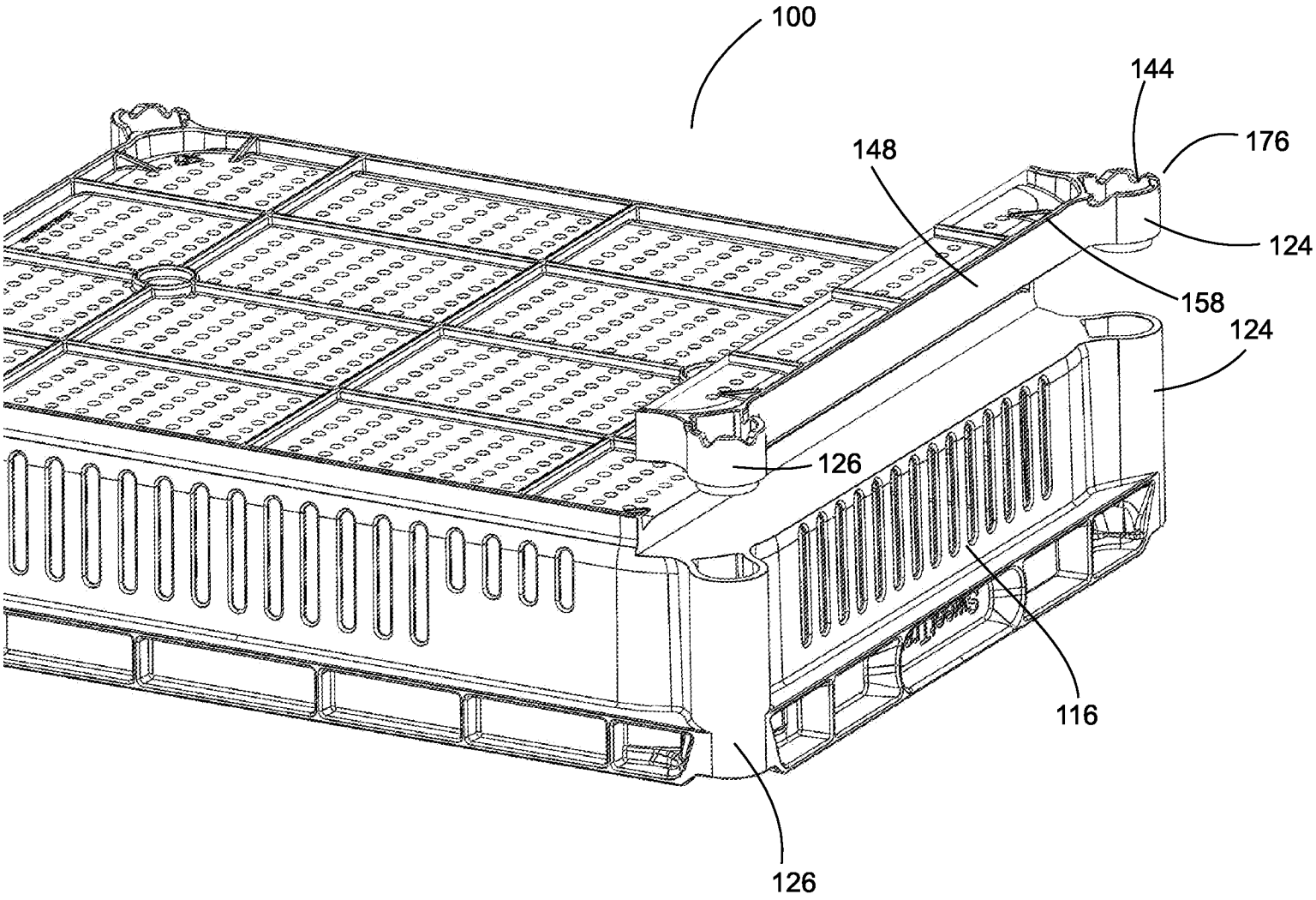
FIG. 18 shows another embodiment of the container.

Referring to FIG. 18, in another embodiment, the container 100 comprises one or more detachable end portions 176. The end portion 176 may extend along at least a portion of one of the sidewalls 114, 116, 118, 120. Preferably, the end portion 176 extends along substantially an entirety of one of the sidewalls 114, 116, 118, 120 such that the end portion 176 includes the lower portion 148 of one of the sidewalls 114, 116, 118, 120, including the foot 158. In addition, the end portion 176 may also include at least a portion of the corner columns 124, 126, 128, 130, including the lower corner edge 142 with the corner notches 144. For example, in the embodiment shown in FIG. 18, the end portion 176 includes a portion of the second sidewall 116 and a portion of the first and second corner columns 124, 126. The embodiment shown in FIG. 18 may be used for larger format containers (such as bulk bins) that may be handled by forklifts. It is understood that the end portion 176 may be located on other parts of the container 100 as well and that the container 100 may comprise more than one of the end portions 176. In this embodiment, the sliding mechanism of the container 100 would be similar to what was described above.

It will be appreciated by those skilled in the art that the preferred embodiment has been described in some detail but that certain modifications may be practiced without departing from the principles of the invention.

The invention claimed is:

1. A container comprising:

a base comprising four base edges defining, at least in part, a perimeter of the base;

four sidewalls, wherein one of the four sidewalls extends from each of the four base edges, each of the four sidewalls comprising:

an upper edge and a lower edge;

an upwardly-extending rail extending proximate to the upper edge;

a curved wall extending proximate to the lower edge; and a downwardly-extending foot extending from the curved wall, wherein the foot is horizontally offset from the rail; and four corner columns extending between adjacent ones of the four sidewalls, each of the four corner columns comprising an outer corner wall, wherein each of the outer corner walls comprise one or more corner notches proximate to a lower edge of the outer corner wall;

wherein at least one of the one or more corner notches on the four corner columns is horizontally aligned with the rail on one of the four sidewalls.

2. The container of claim 1, wherein the foot of each of the four sidewalls is inward of the rail for a same one of the four sidewalls.

3. The container of claim 1, wherein each of the outer corner walls comprises two corner notches, and wherein each of the two corner notches is horizontally aligned with the rail on two of the four sidewalls.

4. The container of claim 1, wherein each of the four corner columns further comprises an inner corner wall, wherein the outer corner wall and the inner corner wall define, at least in part, a corner channel extending for at least a portion of a height of each of the four corner columns.

5. The container of claim 1, wherein all of the four corner columns are shorter than any of the four sidewalls.

6. A storage system comprising:

at least two containers, each of the at least two containers comprising:

a base comprising four base edges defining, at least in part, a perimeter of the base;

four sidewalls, wherein one of the four sidewalls extends from each of the four base edges, each of the four sidewalls comprising:

an upper edge and a lower edge;

an upwardly-extending rail extending proximate to the upper edge;

a curved wall extending proximate to the lower edge; and a downwardly-extending foot extending from the curved wall, wherein the foot is horizontally offset from the rail; and four corner columns extending between adjacent ones of the four sidewalls, each of the four corner columns comprising an outer corner wall, wherein each of the outer corner walls comprise at least one corner notch proximate to a lower edge of the outer corner wall;

wherein a first one of the at least two containers is adapted to slide along at least a portion of a second one of the least two containers through slidable engagement of at least one of the at least one corner notch on one of the four corner columns of the first one of the at least two containers with at least one of the rails on one of the four sidewalls of the second one of at least two containers.

7. The storage system of claim 6, wherein the first one of the at least two containers is adapted to slide along the second one of the at least two containers through slidable engagement of the at least one corner notch on adjacent ones of the four corner columns with the rails on opposing ones of the four sidewalls of the second one of the least two containers.

8. The storage system of claim 6, wherein the first one of the at least two containers is further adapted to stack on top of the second one of the at least two containers by engagement of at least one of the feet of the first one of the at least two containers with at least one of the rails on the second one of the at least two containers.

9. The storage system of claim 8, wherein the first one of the least two containers is further adapted to stack on top of the second one of the at least two containers by engagement of the feet on opposing ones of the four sidewalls of the first one of the at least two containers with the rails on opposing ones of the four sidewalls of the second one of the at least two containers.

10. The storage system of claim 6, wherein for each of the at least two containers, the foot of each of the four sidewalls is inward of the rail for a same one of the four sidewalls.

11. The storage system of claim 6, wherein for each of the at least two containers, each of the outer corner walls comprises at least two corner notches.

12. The storage system of claim 6, wherein for each of the at least two containers, each of the corner columns further comprises an inner corner wall, wherein the outer corner wall and the inner corner wall define, at least in part, a corner channel extending for at least a portion of a height of the corner column.

13. The storage system of claim 6, wherein for each of the at least two containers, all of the four corner columns are shorter than any of the four sidewalls.

* * * * *